US007367695B2

(12) United States Patent
Shiau

(10) Patent No.: US 7,367,695 B2
(45) Date of Patent: May 6, 2008

(54) LED FLASHLIGHT WITH HEAT-DISSIPATING PLATE

(76) Inventor: Wen-Chin Shiau, No. 10, Alley 1, Lane 551, Sec. 1, Wan-Shou Rd., Kuei-Shan Hsiang, Tao-Yuan Hsien (TW)

( * ) Notice: Subject to any disclaimer, the term of this patent is extended or adjusted under 35 U.S.C. 154(b) by 239 days.

(21) Appl. No.: 11/377,061

(22) Filed: Mar. 16, 2006

(65) Prior Publication Data

US 2007/0133197 A1 Jun. 14, 2007

(30) Foreign Application Priority Data

Dec. 9, 2005 (TW) ..... 94143588 A

(51) Int. Cl.
*F21V 29/00* (2006.01)
*F21L 4/00* (2006.01)

(52) U.S. Cl. ..... 362/373; 362/191; 362/202; 362/294

(58) Field of Classification Search ..... 362/294, 362/191, 373, 800
See application file for complete search history.

(56) References Cited

U.S. PATENT DOCUMENTS 6,880,951 B2 * 4/2005 Yoon ..... 362/206
7,153,004 B2 * 12/2006 Galli ..... 362/373

OTHER PUBLICATIONS

U.S. Appl. No. 11/342,082, filed Jan. 27, 2006, entitled "Flashlight" by Won-Chin Shiau, 16 pages.

* cited by examiner

*Primary Examiner*—Sandra O'Shea
*Assistant Examiner*—James W Cranson
(74) *Attorney, Agent, or Firm*—Ladas & Parry LLP

(57) ABSTRACT

A flashlight includes a battery housing, a lamp seat, a lamp unit, a heat-conductive casing, and a heat-dissipating plate. The lamp seat is mounted on one end of the battery housing. The lamp unit includes a substrate having a first side provided with a metal layer, and an LED lamp mounted on a second side of the substrate opposite to the metal layer. The heat-conductive casing is attached to the battery housing, and is disposed around the lamp seat and the lamp unit. The heat-dissipating plate is sandwiched between the lamp seat and the metal layer of the substrate, and is in contact with the heat-conductive casing. Heat generated by the lamp unit is dissipated via the metal layer, the heat-dissipating plate, and the heat-conductive casing.

7 Claims, 4 Drawing Sheets

LED FLASHLIGHT WITH HEAT-DISSIPATING PLATE

CROSS-REFERENCE TO RELATED APPLICATION

This application claims priority of Taiwanese Application No. 094143588, filed on Dec. 9, 2005.

BACKGROUND OF THE INVENTION

1. Field of the Invention

The invention relates to a flashlight, more particularly to a flashlight with a heat-dissipating mechanism for fast heat-dissipation.

2. Description of the Related Art

In Taiwanese utility model no. M244398, entitled "High-illumination LED Flashlight", the applicant discloses a high-illumination light-emitting diode (LED) flashlight, where the power of an LED lamp thereof is approximately equal to 1 watt. The LED lamps used in flashlights prior to the high-illumination LED flashlight only produce power that ranges from 0.1 to 0.2 watts. Therefore, the high-illumination LED flashlight illuminates with higher intensity and brightness. However, since small batteries can only provide limited continuous electric power, the high-illumination LED flashlight developed by the applicant is restricted to small-sized applications, and cannot produce power of higher than 1 watt. Structures of the high-illumination LED flashlight that surround the LED lamp are easily damaged and melt due to intense heat generated by the LED lamp. Consequently, manufacturers are striving to provide an efficient heat-dissipating mechanism for flashlights, whether small-sized or large-sized, with high power and high illumination.

SUMMARY OF THE INVENTION

Therefore, the object of the present invention is to provide a flashlight with a heat-dissipating mechanism that is capable of dissipating heat generated by a lamp unit thereof out of a housing.

According to the present invention, there is provided a flashlight that includes a battery housing, a lamp seat, a lamp unit, a heat-conductive casing, and a heat-dissipating plate. The lamp seat is mounted on one end of the battery housing. The lamp unit includes a substrate having a first side provided with a metal layer, and an LED lamp mounted on a second side of the substrate opposite to the metal layer. The heat-conductive casing is attached to said one end of the battery housing, and is disposed around the lamp seat and the lamp unit. The heat-dissipating plate is sandwiched between the lamp seat and the metal layer of the substrate, and is in contact with the heat-conductive casing. Heat generated by the lamp unit is dissipated via the metal layer, the heat-dissipating plate, and the heat-conductive casing.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
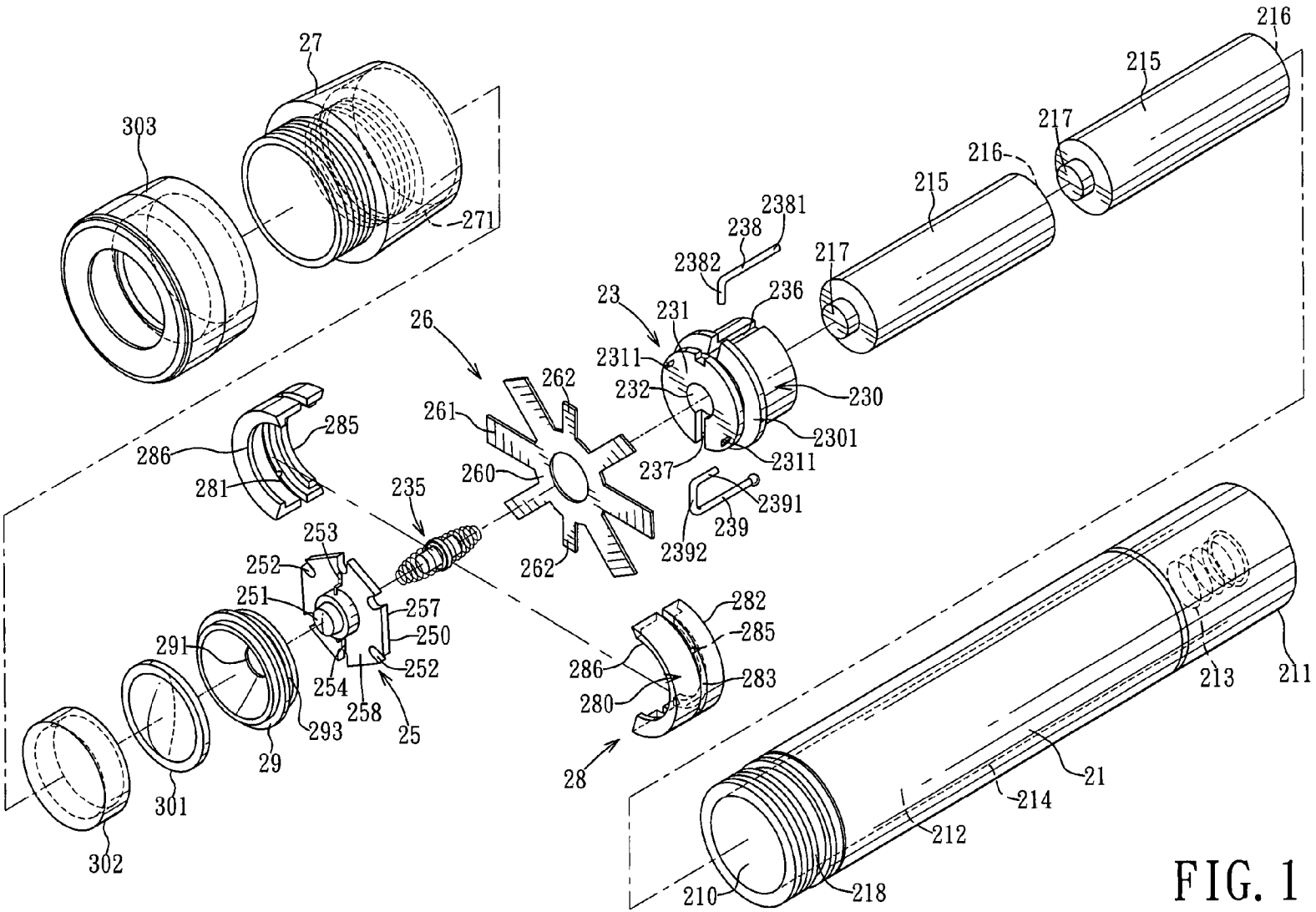
FIG. 1 is an exploded perspective view of the first preferred embodiment of a flashlight according to the present invention.

Before the present invention is described in greater detail, it should be noted herein that like elements are denoted by the same reference numerals throughout the disclosure.

Figure 2:
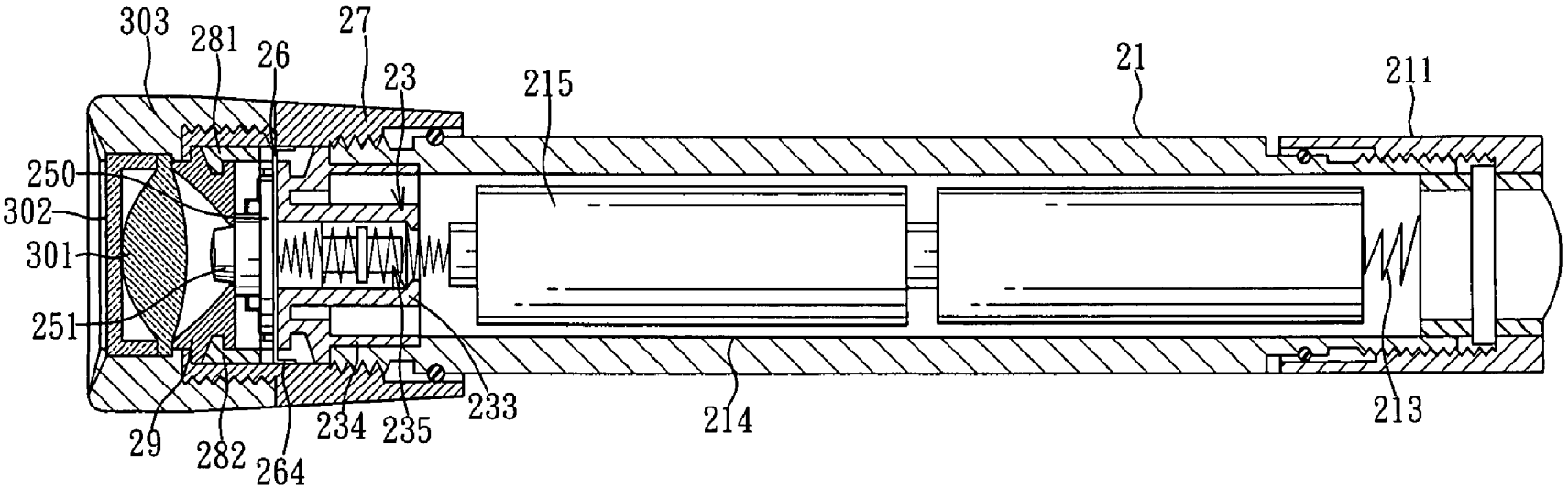
FIG. 2 is an assembled sectional view of the first preferred embodiment.
Figure 3:
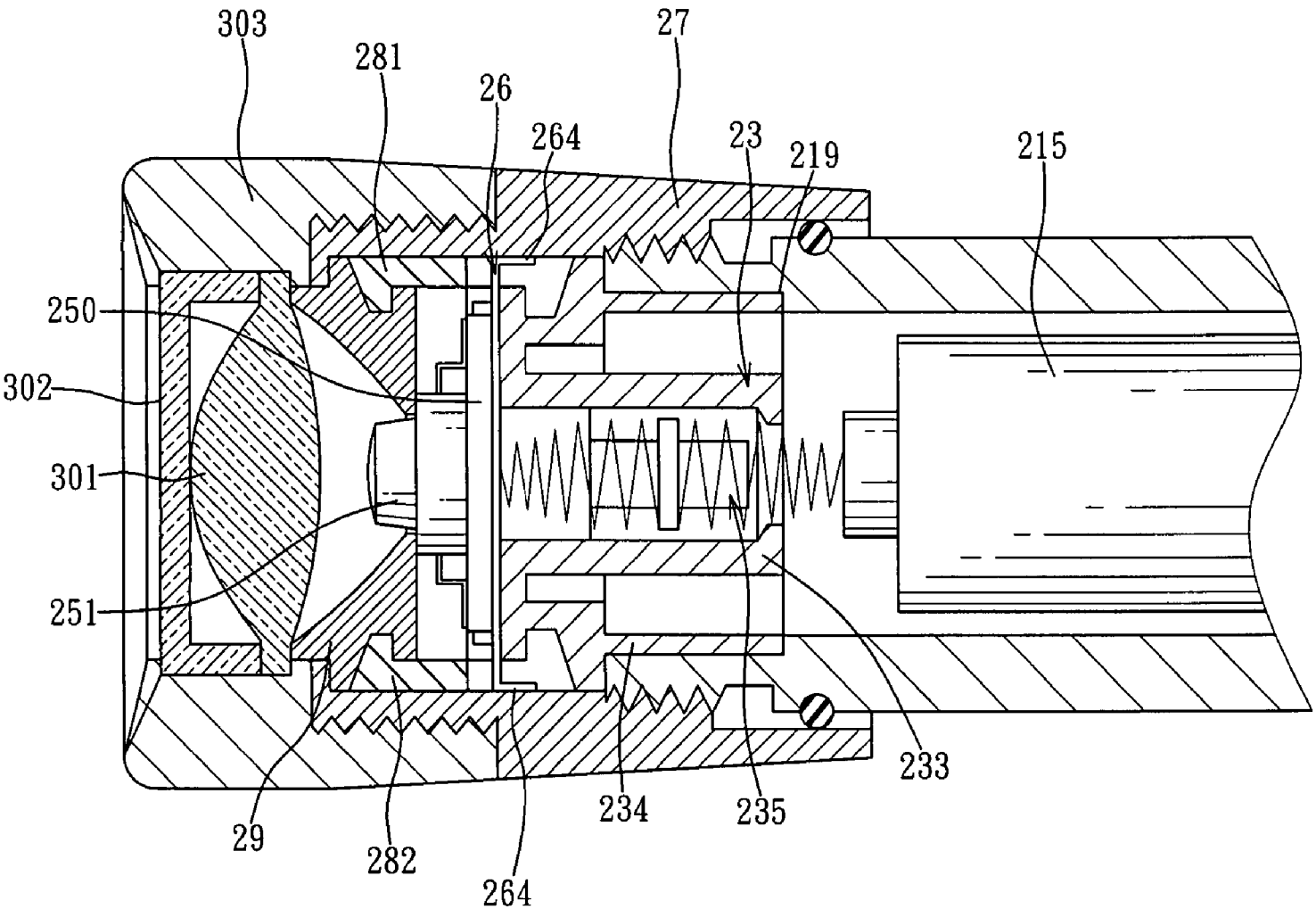
FIG. 3 is an enlarged fragmentary view of FIG. 2.

As shown in FIG. 1, FIG. 2, and FIG. 3, the first preferred embodiment of a flashlight according to the present invention includes a battery housing 21, a lamp seat 23, a lamp unit 25, a heat-dissipating plate 26, a heat-conductive casing 27, a reflector 29, and a protective cover 28.

The battery housing 21 is an elongated tube that is made of a metal material, and has an open end 210 and a closed end 211 that are opposite to each other. A housing wall of the battery housing 21 that is proximate to the open end 210 has an outer wall face formed with an external screw thread 218, and an inner wall face formed with an inner shoulder 219 (shown in FIG. 2 and FIG. 3). The battery housing 21 is formed with a battery-receiving compartment 212 that extends from the open end 210 to the closed end 211, and that is adapted to receive at least one battery therein. The open end 210 permits insertion of the battery into the battery-receiving compartment 212. The battery housing 21 includes a first elastic member 213 that is made of a metal material, and that is disposed in the battery-receiving compartment 212 proximate to the closed end 211. In this embodiment, two batteries 215 are disposed in the battery-receiving compartment 212 such that a negative electrode 216 of one of the batteries 215 contacts the first elastic member 213, thereby establishing an electrical connection among the first elastic member 213, the battery housing 21, and the negative electrodes 216 of the batteries 215. In other words, the first elastic member 213 and the battery housing 21 are both negatively charged.

The lamp seat 23 is mounted on the open end 210 of the battery housing 21, and abuts against the inner shoulder 219 of the inner wall face of the housing wall. The lamp seat 23 includes a support base 230, a lamp seat inner tubular wall 233, and a lamp seat outer tubular wall 234. The support base 230 has a first surface 231 that is in contact with the heat-dissipating plate 26, and is formed with a lamp seat central hole 232. The lamp seat inner tubular wall 233 extends from the lamp seat central hole 232 in a direction away from the heat-dissipating plate 26. The lamp seat outer tubular wall 234 extends laterally from the support base 230 around the lamp seat inner tubular wall 232. In this embodiment, the lamp seat 23 further includes a second elastic member 235 that is made of a metal material, and that is disposed in the lamp seat central hole 232. The second elastic member 235 has a length such that when the second elastic member 235 is received in the lamp seat central hole 232, two ends thereof extend outwardly of the support base 230. The end of the second elastic member 235 contacts a positive electrode 217 of the other one of the batteries 215. In other words, the second elastic member 235 is positively charged.

Moreover, the lamp seat 23 is provided with a first groove 236 that extends axially in the lamp seat outer tubular wall 234, and a second groove 237 that extends radially in the support base 230 and that is connected to the lamp seat central hole 232.

Further, the lamp seat 23 is provided with a first annular groove 2301 that extends annularly in the lamp seat outer tubular wall 234, and that is disposed proximate to the first surface 231 of the support base 230. The first surface 231 is provided with a pair of symmetrical securing teeth 2311.

The lamp unit 25 includes a substrate 250 and an LED lamp 251. The substrate 250 is substantially polygon-shaped, and has a metal layer 257 at a first side thereof. The LED lamp 251 is mounted on a second side 258 of the substrate 250 opposite to the metal layer 25. In this embodiment, the substrate 250 is substantially hexagonal, and further has an outer periphery formed with a plurality of angularly spaced apart notches 252. Each of the notches 252 is disposed between two adjacent sides of the hexagonal substrate 250. In other words, the substrate 250 has six notches 252. The substrate 250 includes first and second electrodes 253, 254 that are connected to two leads of the LED lamp 251, respectively. The metal layer 257 of the substrate 250 aids in dissipating heat generated by the LED lamp 251.

The heat-dissipating plate 26 is sandwiched between the first surface 231 of the support base 230 of the lamp seat 23 and the metal layer 257 of the substrate 250 of the lamp unit 25, and is in contact with the heat-conductive casing 27. In particular, the heat-dissipating plate 26 includes a central part 260, and a plurality of fins 261 extending outwardly and radially from the central part 260 to contact an inner surface 271 of the heat-conductive casing 27. The number of fins 261 is chosen to be equal to the number of sides of the substrate 250. The fins 261 project outward from the sides of the substrate 250, respectively.

The lamp seat 23 further includes a first conductor 238 that extends into the first groove 236, and a second conductor 239 that extends into the second groove 237. In this embodiment, the first and second conductors 238, 239 are in the form of bent rods. The first conductor 238 has a portion 2381 in contact with an inner surface 214 of the battery housing 21 such that the first conductor 238 is in electrical connection with the battery housing 21. The second conductor 239 has a portion 2391 that extends into the lamp seat central hole 232 and that contacts the second elastic member 235, which in turn is connected to the positive electrode 217 of the batteries 215, and another portion 2392 that extends radially in the second groove 237.

When the lamp seat 23, the substrate 250, and the heat-dissipating plate 26 are assembled, the first and second electrodes 253, 254 of the substrate 250 are aligned respectively with the first and second grooves 236, 237. The securing teeth 2311 of the first surface 231 respectively engage two of the notches 252 in the substrate 250. Subsequently, the first and second electrodes 253, 254 are respectively soldered to another portion 2382 of the first conductor 238 and the portion 2392 of the second conductor 239, thereby connecting the first electrode 253 electrically to the first conductor 238, the battery housing 21, the first elastic member 213, and the negative electrodes 216 of the batteries 215, while connecting the second electrode 254 electrically to the second conductor 239, the second elastic member 235, and the positive electrodes 217 of the batteries 215. Consequently, the LED lamp 251 can be activated when a closed circuit is made.

In this embodiment, the heat-dissipating plate 26 further includes at least two anchoring fingers 262, each of which extends radially and outwardly from the central part 260 between two adjacent ones of the fins 261. Each of the anchoring fingers 262 is folded backward and extends to the second side 258 of the substrate 250 through one of the notches 252.

The heat-conductive casing 27 is attached to the open end 210 of the battery housing 21, and is disposed around the lamp seat 23, the heat-dissipating plate 26 and the lamp unit 25. The heat-conductive casing 27 is sleeved around the open end 210 of the battery housing 21, and engages threadedly the external screw thread 218. The lamp seat outer tubular wall 234 is inserted into the open end 210 of the battery housing 21. The heat generated by the LED lamp 251 is dissipated via the metal layer 257 of the lamp unit 25, the heat-dissipating plate 26, the heat-conductive casing 27, and the battery housing 21.

The reflector 29 is disposed adjacent to the second side 258 of the substrate 250 of the lamp unit 25, and is formed with a through hole 291 for extension of the LED lamp 251 therethrough, and a second annular groove 293.

The protective cover 28 has a cover wall 280 disposed inside the heat-conductive casing 27. The cover wall 280 surrounds the lamp seat 23, the lamp unit 25 and the heat-dissipating plate 26. The fins 261 of the heat-dissipating plate 26 penetrate the cover wall 280, and have bent end parts 264 (as shown in FIG. 2 and FIG. 3) that extend axially and outwardly of the cover wall 280 and that are sandwiched between the cover wall 280 and the heat-conductive casing 27.

In this embodiment, the protective cover 28 has two cover components 281, 282 that cooperate with each other to form the cover wall 280. The cover components 281, 282 have semicircular cross-sections such that the cover wall 280 has a circular cross-section. Each of the cover components 281, 282 is provided with first and second ridges 285, 286 disposed proximate to the lamp seat 23 and the reflector 29, respectively, and apertures 283 for outward extension of the bent end parts 264 of the fins 261 of the heat-dissipating plate 26. When the cover components 281, 282 are assembled to form the cover wall 280, the first ridges 285 engage the first annular groove 2301 of the support base 230 of the lamp seat 23, the second ridges 286 engage the second annular groove 293 of the reflector 29, and the apertures 283 have the bent end parts 264 of the fins 261 extending outwardly thereof.

The flashlight further includes a lens 301, a protective shield 302, and a reflector housing 303, which are assembled with the heat-conductive casing 27. The heat-conductive casing 27 surrounds the cover wall 280 of the protective cover 28, and abuts against the bent end parts 264 of the fins 261. The lens 301 and the protective shield 302 are movable with the reflector housing 303. The threaded engagement between the reflector housing 303 and the heat-conductive casing 27 permits adjustments to the distance between the lens 301 and the LED lamp 251, i.e., focusing adjustments.

With the present invention, the heat generated by the LED lamp 251 can be rapidly dissipated via the metal layer 257 of the lamp unit 25, the heat-dissipating plate 26, the heat-conductive casing 27, and the battery housing 21, thereby protecting components of the flashlight from damage due to the heat generated even when the power of the LED lamp 251 is chosen to exceed 1 watt.

Figure 4:
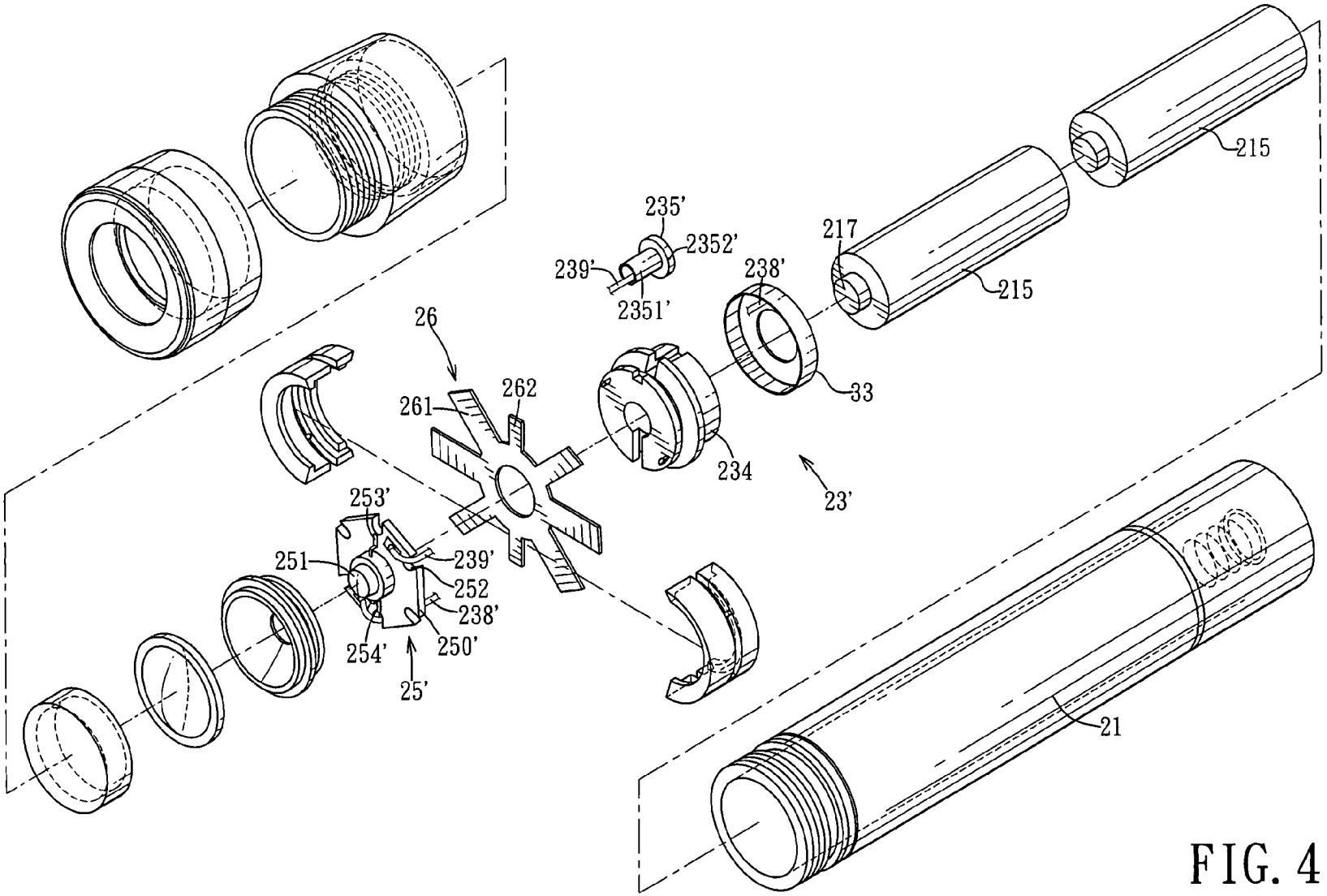
FIG. 4 is an exploded perspective view of the second preferred embodiment of a flashlight according to the present invention.

As shown in FIG.4, the second preferred embodiment of a flashlight according to the present invention differs from the first preferred embodiment only in the lamp seat 23' and the lamp unit 25'.

Instead of the second elastic member 235 employed in the first preferred embodiment, the lamp seat 23' includes a conductive insert 235' having an insert tubular wall 2351' inserted into the lamp seat inner tubular wall 233 (as shown in FIG. 3) and an end plate 2352' in contact with the positive electrode 217 of one of the batteries 215. In addition, the lamp seat 23' further includes a conductive cap 33 sleeved onto the lamp seat outer tubular wall 234 and contacting an inner surface of the battery housing 21. The first conductor 238' is connected electrically to the end plate 2352' of the conductive insert 235' and the first electrode 253' of the substrate 250' of the lamp unit 25'. The second conductor 239' is connected electrically to the conductive cap 33 and the second electrode 254' of the substrate 250'. The lamp seat 23' according to the second preferred embodiment is capable of achieving the same effects and advantages as the first preferred embodiment.

While the present invention has been described in connection with what is considered the most practical and preferred embodiments, it is understood that this invention is not limited to the disclosed embodiments but is intended to cover various arrangements included within the spirit and scope of the broadest interpretation and equivalent arrangements.

What is claimed is:

1. A flashlight comprising:

a battery housing;

a lamp seat mounted on one end of said battery housing;

a lamp unit including a substrate having a first side provided with a metal layer, and an LED lamp mounted on a second side of said substrate opposite to said metal layer;

a heat-conductive casing attached to said one end of said battery housing and disposed around said lamp seat and said lamp unit; and a heat-dissipating plate sandwiched between said lamp seat and said metal layer of said substrate, and in contact with said heat-conductive casing, wherein heat generated by said lamp unit is dissipated via said metal layer, said heat-dissipating plate, and said heat-conductive casing.

2. The flashlight as claimed in claim 1, wherein said heat-dissipating plate includes a central part, and a plurality of fins extending outwardly and radially from said central part and contacting an inner surface of said heat-conductive casing.

3. The flashlight as claimed in claim 2, wherein said substrate of said lamp unit further has an outer periphery formed with a plurality of angularly spaced apart notches, said heat-dissipating plate further including at least two anchoring fingers each extending radially and outwardly from said central part between two adjacent ones of said fins, each of said anchoring fingers being folded backward and extending to said second side of said substrate through one of said notches.

4. The flashlight as claimed in claim 3, further comprising a protective cover having a cover wall disposed inside said heat-conductive casing, said cover wall surrounding said lamp unit, said heat-dissipating plate, and said lamp seat, said fins penetrating said cover wall and having bent end parts that extend axially and outwardly of said cover wall and that are sandwiched between said cover wall and said heat-conductive casing.

5. The flashlight as claimed in claim 4, wherein said protective cover has two cover components which cooperate with each other to form said cover wall and each of which has apertures for outward extension of said bent end parts of said fins.

6. The flashlight as claimed in claim 3, wherein said substrate further includes first and second electrodes, said lamp seat including a support base in contact with said heat-dissipating plate, a lamp seat central hole formed in said support base, a lamp seat inner tubular wall extending from said lamp seat central hole in a direction away from said heat-dissipating plate, a lamp seat outer tubular wall extending laterally from said support base around said lamp seat inner tubular wall, a first groove extending axially in said lamp seat outer tubular wall, a second groove extending radially in said support base and connected to said lamp seat central hole, a first conductor connected to said first electrode and extending into said first groove, and a second conductor connected to said second electrode and extending into said second groove.

7. The flashlight as claimed in claim 6, wherein said one end of said battery housing has a housing wall formed with an external screw thread, said heat-conductive casing being sleeved around said housing wall and engaged threadedly with said external screw thread, said lamp seat outer tubular wall being inserted into said housing wall.

* * * * *